US006715543B1

(12) United States Patent
Svindland

(10) Patent No.: US 6,715,543 B1
(45) Date of Patent: Apr. 6, 2004

(54) PARTICULATE MATTER PLUG FOR PLUGGING A WELL

(75) Inventor: Alf Svindland, Sola (NO)

(73) Assignee: Sandaband, Inc., Nassau (BS)

( * ) Notice: Subject to any disclaimer, the term of this patent is extended or adjusted under 35 U.S.C. 154(b) by 0 days.

(21) Appl. No.: 10/089,811

(22) PCT Filed: Sep. 22, 2000

(86) PCT No.: PCT/NO00/00310

§ 371 (c)(1),
(2), (4) Date: Apr. 3, 2002

(87) PCT Pub. No.: WO01/25594

PCT Pub. Date: Apr. 12, 2001

(30) Foreign Application Priority Data

Oct. 4, 1999 (NO) ..... 19994813

(51) Int. Cl.[7] ..... E21B 33/13
(52) U.S. Cl. ..... 166/192; 166/135
(58) Field of Search ..... 166/135, 192, 166/179, 153, 285, 292

(56) References Cited

U.S. PATENT DOCUMENTS 3,866,681 A 2/1975 Shirley
5,417,285 A 5/1995 Van Buskirk et al.
5,479,986 A * 1/1996 Gano et al. ..... 166/292
5,657,822 A 8/1997 James et al.
5,667,010 A * 9/1997 Boyd et al. ..... 166/292

OTHER PUBLICATIONS

Article from Norwegian Petroleum Directorate's (NPD) magazine "Sokkelspeilet", No. 2, 1999, pp. 12–13.

* cited by examiner

*Primary Examiner*—Zakiya Walker

(57) ABSTRACT

A particulate matter plug is placed along all or portions of a well to be permanently or temporarily abandoned, the plug being arranged to hinder/reduce fluid flow to surface. The plug consists of a mass of particulate matter composed of naturally occurring and/or synthetically produced granular matter, including gravel, sand, silt, clay and a mixture of these, and preferably of a poorly sorted mass of particulate matter. The granular particulate matter having average particle diameters included in the statistical range of variation of the mass is comprised of particles with an average particle diameter >1/256 millimeters, thus comprising approximately ⅔ of all particles in the mass.

26 Claims, 3 Drawing Sheets

PARTICULATE MATTER PLUG FOR PLUGGING A WELL

CROSS REFERENCE TO RELATED APPLICATION

The present application is the U.S. national stage application of International Application PCT/NO00/00310, filed Sep. 22, 2000, which international application was published on Apr. 12, 2001 as International Publication WO 01/25594. The International Application claims priority of Norwegian Patent Application 19994813, filed Oct. 4, 1999.

FIELD OF THE INVENTION

The invention concerns a mixture of particulate matter to hinder/reduce migration of formation fluids in wells, primarily in connection with plugging of wells related to exploitation of hydrocarbons. Formation fluids encompass both liquids and gases in the sub-terrain.

BACKGROUND OF THE INVENTION

Plugging of wells is on the most part carried out by removing the production tubing, upper part of well casings and other superfluous well equipment to the extent that this is possible and necessary. Simultaneously with or prior to the plugging, one or several mechanical plugs are placed in the well, eventually combined with one or several cement plugs. The plugs are commonly placed within a few well intervals, and these represent only a small fraction of the total volume in the well. Similarly, for example related to production, it may be required to perform zone isolation in the well by plugging. The plugging is carried out to hinder eventual fluids in the formations, including hydrocarbons, from leaking to the surface or eventually to another formation in the well, where such leaks would create unwanted and eventual dangerous situations.

The conventional technique for plugging of wells usually requires much work and time and is therefore rather expensive, especially for offshore wells. Much of the work is related to preparations before the plugging operation, such as among others cutting and removal of downhole casings and production tubing(s). The quality of these preparatory works have great impact on how efficiently one manages to place mechanical and/or cement plugs, and on how well the plugs keep a tight seal afterwards. After the placement in the well the metal in the mechanical plugs and in the casings remaining in the well are subjected to corrosion. This will, in the foreseeable future reduce the thickness of the metal by corrosion, eventually they crack under the prevailing physical loads and leakage will occur. Eventual displacements in the Earth's crust can also damage mechanical plugs and cement plugs and make them deform and eventually become fractured. These plugs lack the ability to conform to changes in their environments and will therefore not maintain their function to hinder flow.

An article in the Norwegian Petroleum Directorate's (NPD) magazine 'Sokkelspeilet', No. 2, 1999, pp. 12–13, speaks about the risk for well leaks resulting from Earth crust displacements, alluded to above, and where the NPD's concern is to bring forward a method for well plugging that shall have a sufficient durability that in principle is the perspective of eternity.

Although NPD in principle wants the perspective of eternity for the durability of well securing, it is in practice reasonable to assume that well plugs are never absolutely tight for all times. Another practical question concerns what may be viewed as being sufficient well securing.

The purpose of the present invention is to make available a simple and less expensive method for hindering/reducing unwanted migration of formation fluids in wells, primarily in connection with plugging of wells related to the exploitation of hydrocarbons. The invention also aims at making available a more flexible and durable plugging of such wells.

SUMMARY OF THE INVENTION

The purpose is, as described in the characteristic in the present independent and dependent patent claim, realised by preferably applying a poorly sorted mass of naturally occurring and/or synthetic produce of granulated material, eventually like material suspended in a suitable carry fluid, to be placed suitably in the well, eventually also around remaining casings in the well, production tubing, eventually other equipment left in the well, in the entire or portions of the well.

The principle behind the method is known from natural sedimentological processes, and is applied in construction activities, among others for building of the core of dams and dikes. The novelty is that the principle is carried further in the form of a new method whereby a defined mass of particulate matter constitutes the main, preferred material for plugging of wells. The application of the method requires acceptance that a packed particulate matter with low permeability can form a sufficiently impermeable well plug. The mass can for example consist of a poorly sorted mixture of granule, sand, silt and clay. Sorting is among others, a measure of the degree of variability, or width of variation of the different particle sizes in the aggregate mass. The notion of sorting also expresses the distribution of these particle sizes in the aggregate, that yields a statistical description by means of a cumulative distribution function.

A poorly sorted particulate matter consists of particles including several particle sizes. In comparison, a moderately sorted mass consists of a small number of categories of particle sizes, for example medium sand and fine sand, while a well sorted mass includes one category of particle sizes, for example coarse silt. Other examples of particle size categories are very coarse sand (particle diameter 1–2 mm), coarse sand (particle size diameter 0.5–1 mm), very find sand (particle-diameter 0.0625–0.125 mm), fine silt (particle diameter 0.008–0.016 mm), and so forth. These are examples from the so-called Udden-Wentworth scale of particle sizes.

In statistical terms, each particle size category is often expressed by a variation width given as $\phi$-values, where $$\phi = -\log_2 d \quad (d = \text{average particle diameter})$$

As examples, fine silt has $\phi$-values between 6 and 7 and medium silt has $\phi$-values between 5 and 6. The accompanying scale of particle sizes is known as the Krumbein phi ($\phi$) scale. The distribution of particle sizes in the mass is commonly given by the variation width (in $\phi$-values) that include approximately ⅔ of all the particles in the mass. Statistically this variation width equals two times the standard deviation. The standard deviation is therefore a commonly accepted measure for the sorting of a sediment or a mass of particulate matter.

Both the Udden-Wentworth scale and the Krumbein $\phi$-scale and is other notions are generally known and applied within among others, geological disciplines. There are also other similar scales and/or terminology that in varying degrees are used within different geographical areas and/or engineering disciplines.

The composition of the mentioned particulate material mass must be adapted to the well conditions and objectives one wishes to accomplish for the individual well. There may also be conditions where the composition of the particulate matter can be varied along the length of the well if this appears to be preferable. The mentioned particulate matter mass replaces, eventually is used in combination with conventional mechanical plugs and/or cement plugs, eventually also in combination with other plug types containing e.g. resin or similar additives.

After placement in the well, the particulate matter should over a large length in the well be such sorted, packed and eventually contain a sufficiently irregular form, such that appreciable migration of formation fluid is hindered. Alternatively, the same effect can be achieved by placement of a homogenous and fine-grained particulate matter, such as silt and/or clay in the well. This lastly named alternative however appears impractical since the placement of such a mass would be far more time consuming, and the fine grains require a long time to sediment from the fluidised mass. The mixed in fluid, a so-called carry fluid, must also have viscosity, specific gravity and/or other physical/chemical properties designed for the/those specific objectives one wants to achieve.

The low permeability of the particulate matter results in that a fluid front will move slowly through the mass. The velocity of the fluid front through the particulate material is controlled by adapting the composition of particle sizes and the length of the particulate material plug(s) according to the properties of the migrating fluid, for example the viscosity, such that the time to migrate through becomes acceptably long. In addition the gravitational force of the Earth will over time further pack the particles together, similar to the physical changes that occur in a naturally deposited sediment after the sedimentation. In this regard, it is theoretically possible to obtain a time for migrating through of more than 1000 years for a formation fluid migrating from a depth of more than 1000 meter under the solid surface of the Earth. Darcy's Law describes the parameters and the relation that influence on the migration front velocity through a porous and permeable material;

$$v=k\cdot(P_{in}-P_{out})/(\mu\cdot L);\text{ where,}$$

v—the migration velocity of the fluid (in cm/sec)

k—the effective permeability to the fluid in the material (in Darcy)

$P_{in}$—the inlet pressure (in atmospheres)

$P_{out}$—the outlet pressure (in atmospheres)

$\mu$—the kinematic viscosity of the flowing fluid (in centiPoise)

$\mu$—the length of the permeable material (in cm).

As an illustration of this, calculations performed on the premise of a 3000 meter long vertical well from a depleted reservoir where the pore pressure can build up to 300 atmospheres and where the permeability of the particulate matter plug has a permeability of 0.001 Darcy and the pores in the plug are full initially of fresh water, show that it would take more than 20,000 years for the reservoir fluid to migrate from the reservoir to the surface. If the plug's pores were initially full of seawater the time to migrate through would be about 60,000 years. These calculations premise static parameters and that these do not change with time. We know that naturally deposited sediments become subjected to physical and chemical changes, so-called diagenetic changes, that over geological time commonly lead to solidification of sediments. It may therefore be justified to assume that a plug of particulate material will also be subjected to such changes and that the porosity of the plug and its permeability will gradually decrease, which in due course results in increasing degree of hindering/reducing the migration of formation fluids through the plug. Earth crust movements can for example lead to that a partially or totally petrified mass becomes fractured, and that formation fluids then flow through the fractures upwardly in the well. However, we know that diagenetic changes usually happen in the run of thousands of years or more. It is therefore most probable that the plug will remain deformable in such a time perspective and that it will conform to eventual changes in the geometry of the well and that it will thus maintain its function as a plugging material.

It is possible to design most of the parameters in the Darcy Law. The permeability in the particulate matter plug is a function of the sorting and the packing of the particles. In addition the permeability is relative to the pore saturation of the flowing fluid, in the oilfield terminology called the relative permeability. The length of the plug(s) is also controllable. The pore fluid of the plug may also consist of fluid thickening substances that increase the viscosity of the fluid.

According to Darcy's Law a fluid will not flow through a permeable material if the pressure drop across $(P_{in}-P_{out})=0$, eventually if the product $(\mu\cdot L)=\infty$. The pressure drop can simply be eliminated by placing a suitable liquid over a sufficient well length to obtain a hydrostatic head pressure equal to the pressure of the formation fluid. Strictly theoretical this should be sufficient to prevent formation fluids from entering into the well. In practise the pressure in the reservoir fluids will change slightly over time, and in addition the hydrostatic pressure from the liquid mentioned above may also change over time, for example as a consequence of leaks to/from the surrounding formations in the ground. Under these conditions for a liquid filled well a pressure drop may develop with a resulting flow of formation fluids up through the well. A plug of particulate material will hinder/reduce such a leak in the future.

The placement of a plug of particulate matter in a well can be most easily done by mixing the particulate matter with a suitable liquid to make it possible to pump or dump as a slurry. The mass can for example be pumped through the production tubing simultaneously with it being removed from the well, eventually that the slurry in a suitable way is pumped into the well after the production tubing being removed. In some cases, for example for placement of a particulate mass containing a large fraction of clay it may be necessary to gradually build a plug by repeatedly lowering by wire line a cartridge containing the particulate mass, in a bailer, and dump the mass in the well. Oftentimes one plug wells with wellhead pressure higher than 1 atmosphere. Then it may be necessary to utilise high pressure operating technique, so-called snubbing, in order that the well operation is done in full control. Such snubbing technique can for example be done with a snubbing unit, coiled tubing or drill-pipe. When the production tubing is removed and when it is impossible to inject a carry fluid into an underground reservoir, using a coiled tubing may be the quickest and most applicable way for placing a long particulate matter plug, whether it is for wells with the wellhead on a platform, at the seabed or on land. For plugging when a drill rig is available the placement of a particulate matter plug through ordinary drill-pipes may be the most practical and economical way. The technique for placement of the particulate matter plug will be evaluated for each individual well with respect to the mechanical conditions of the well and with regard to what equipment is available.

The well will be filled to the required extent, preferably by a fluidised mass that after placement and in its final form is a more rigid but still malleable material. Into the particulate matter can eventually be added ingredients that result in concentration and flocculation and more rapid sedimentation of the smallest particles, such as clay particles.

In addition to the long time for a fluid front to migrate through the particulate matter plug(s), the plug has the ability to largely remain in a malleable state for a long period after the placement. This ability infers that the particulate matter plug can adapt itself to eventual changes in the geometry of the well and thus will maintain its function as a plug. Such changes can appear as a consequence of displacements in the Earth's crust, where the displacements may be caused by larger, naturally occurring Earth crust movements or as a consequence of production related changes in a reservoir. Volumetric changes may also take place as a result of corrosion of the metal in the well.

A further advantage with the invention is achieved when such a particulate matter is utilised for temporary plugging of a well. For subsequent need, it is much easier and cost effective to remove this plug than to remove mechanical and/or cement plugs.

Furthermore, the particulate matter plug may partly utilise/consist of drill cuttings from the well itself, eventually also from other drill holes. Then an otherwise often problematic disposal product from drilling operations may have a useful and cost saving utilisation.

The particulate material's pores can after placement in the well be filled by a salty liquid (brine), for example when the carry fluid consists of a salty liquid. The fluid will then exert a hydrostatic pressure in the drill-hole that in itself may represent a complete pressure barrier against the formation's pore pressure.

BRIEF DESCRIPTION OF THE DRAWINGS

In the following part of the description and with referencing to the set of figures, will be referenced to 3 different figures, where two figures depict the conventional technique and one figure shows an example of using the invention. One reference number refers to the same detail in all the figures where such a detail is shown, and where.

All the figures are very much off scale as concerns physical dimensions, lengths and component details.

DETAILED DESCRIPTION OF THE PRESENT INVENTION

The invention concerns as stated above a method to hinder/reduce migration of formation fluids in wells, primarily in connection with plugging of wells related to exploitation of hydrocarbons. Well equipment and/or conditions that do not directly concern the invention itself, but that are necessary pre-conditions for being able to apply the invention, are not given or described in detail as these are well known to the professional persons.

Figure 1:
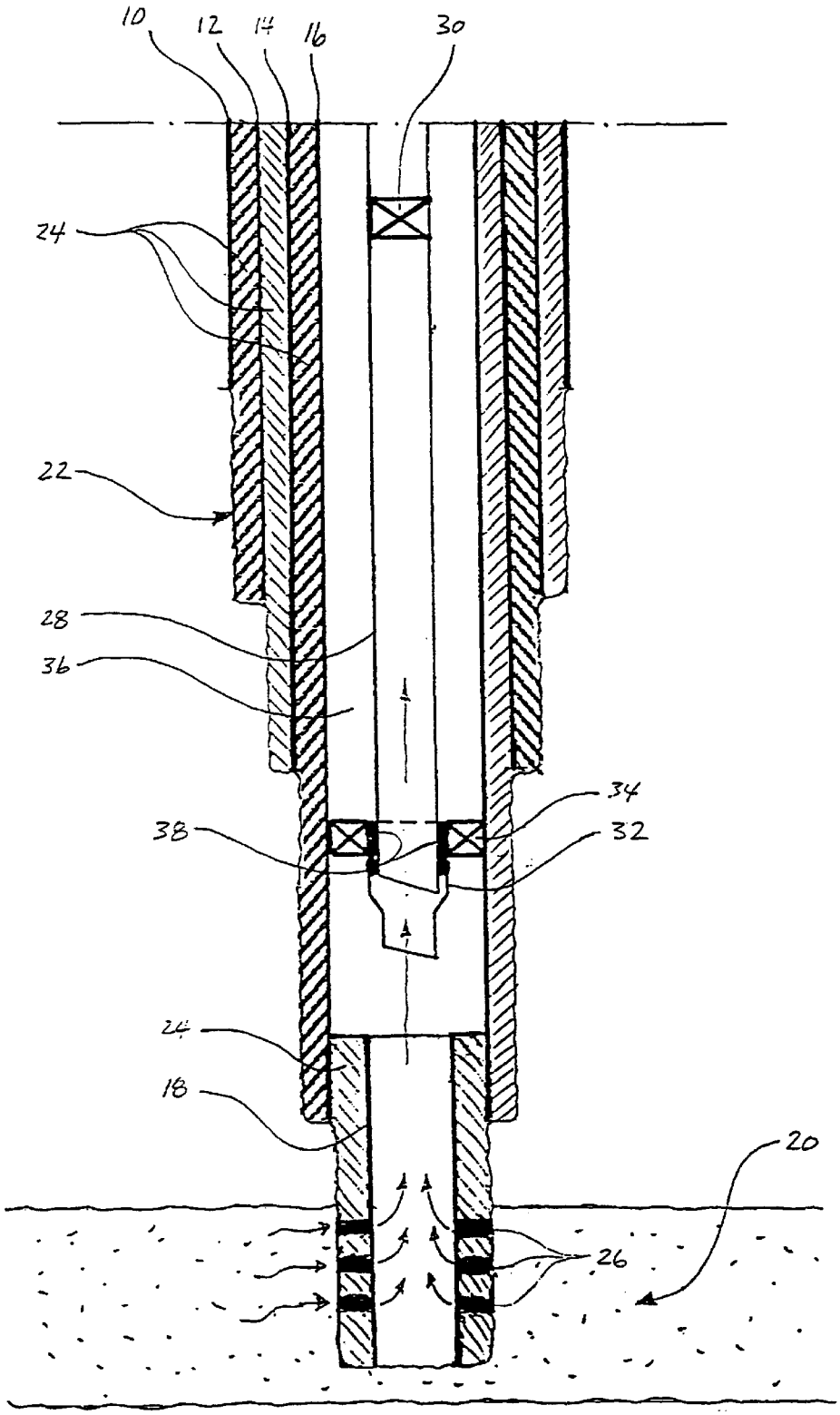
FIG. 1 shows a schematic cross section of how a typical producing well is built.

FIG. 1 is included as a reference in order to illustrate a typical construction of a production well. The well consists of a series of drilled intervals where each subsequent interval has a smaller bore hole diameter than the previous one in the more shallow interval. Each bore hole diameter interval is equipped with an accompanying casing 10, 12, 14 and 16 inside the/those previous and more shallow casing(s) 10, 12 or 14. Such casings 10, 12, 14 and 16 are usually ending in a wellhead placed at the surface. The deepest and last casing 18 in the lower section penetrates and runs through a reservoir 20, while the upper end is fastened inside the lowest part of the previous casing 16. When this casing 18 does not extend to the surface, it is commonly referred to as a liner. The annuli between the drilled hole wall 22 and the casings 12, 14 and 16, are commonly filled s totally or partly by cement 24. In locations where it is possible, the shallowest casing 10 is usually driven down into the shallow material below the surface, without a subsequent cementing.

The communication with and production from the reservoir 20 comes through at least one perforation 26 through the liner 18 and the cement around it 24 (or from open hole section, 'barefoot completion'). In this example the reservoir fluid is produced through the liner 18 and further into a production tubing 28. The direction of flow is in FIG. 1 given by arrows. Further, near the surface and inside the production tubing 28 is placed a down-hole safety valve 30.

The production tubing 28 is fixed to the casing 16 by means of a production packer 32. The production packer 32 is equipped with one or several sealing elements 34 to avoid that the reservoir fluids can flow from the reservoir 20 and into the annulus 36 between the production tubing 28 and the casing 16. The production packer 32 has in the upper end also an internal diameter that makes it possible to enter and connect with the lower part of the production tubing 28, and this end is equipped with external, packing rings 38 to achieve a pressure tight connection. Such a configuration likewise makes a disconnect easy of the production tubing 28 from the production packer 32. The lower part of the production packer 32 functions as the inlet for produced reservoir fluids and is often made with a smaller diameter than the upper section. The lower section often has a special made form in order to more easily be able to run for example well maintenance equipment through this bevelled opening and in or out of the production tubing 28.

Figure 2:
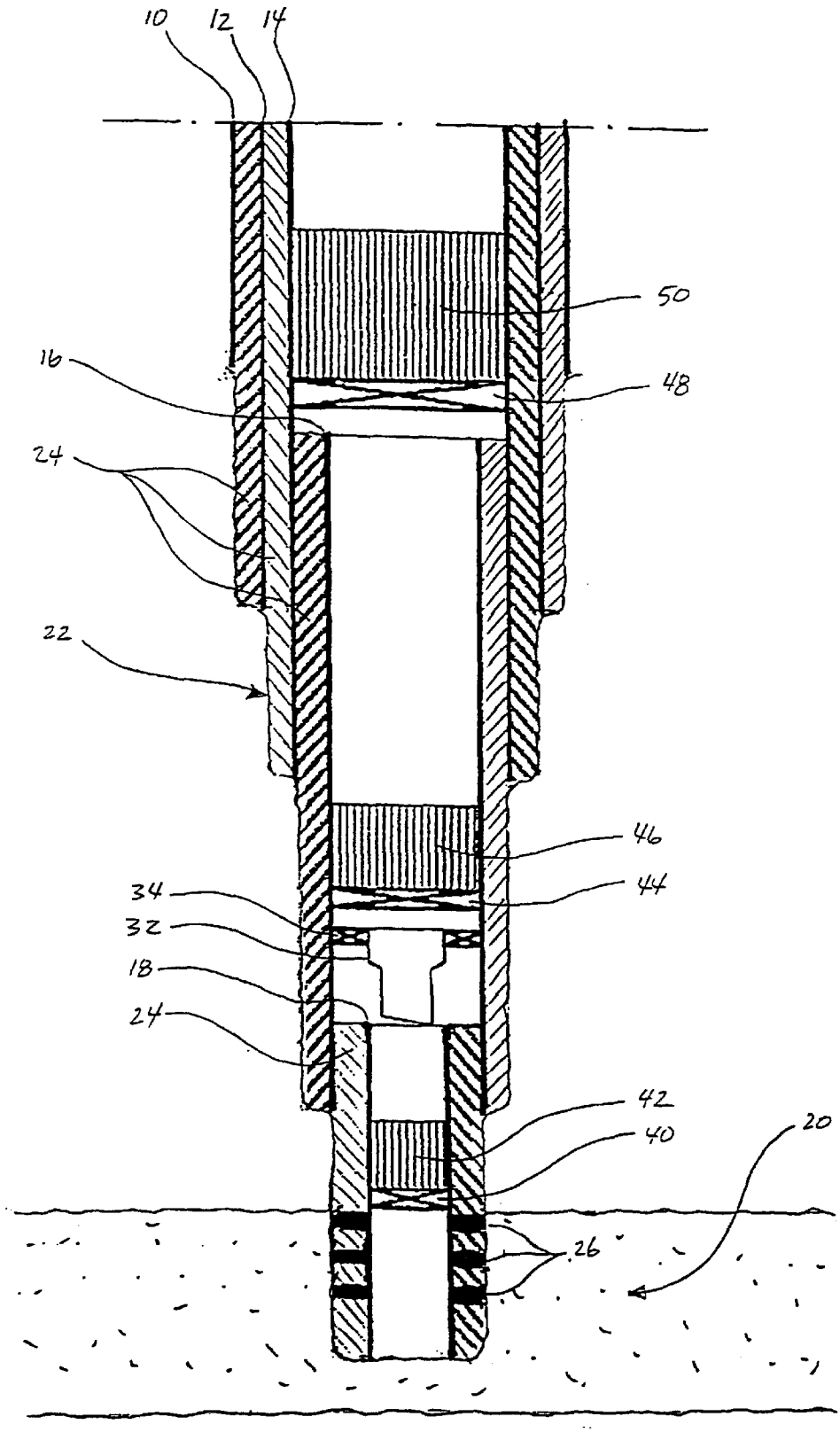
FIG. 2 shows a schematic cross section of how a typical production well is plugged in the conventional manner.

Conventional plugging of such a production well is shown in the FIG. 2. In this example the production tubing 28 is disconnected and removed. A mechanical plug 40 is covered right on top by a cement plug 42, is placed right above the perforations 26 inside the liner 18. The casing 16 is plugged above the production packer 32 by a mechanical plug 44 and a cement plug 46 directly on top. The upper portion of the casing 16 has in this example been removed. A mechanical plug 48 is set in the casing 14 right above the cut end of the casing 16. One or several longer cement plugs 50 are then placed above the mechanical plug 48 in the remaining casing 15 14 volume until close to the sea-bottom, eventually to the land surface.

Figure 3:
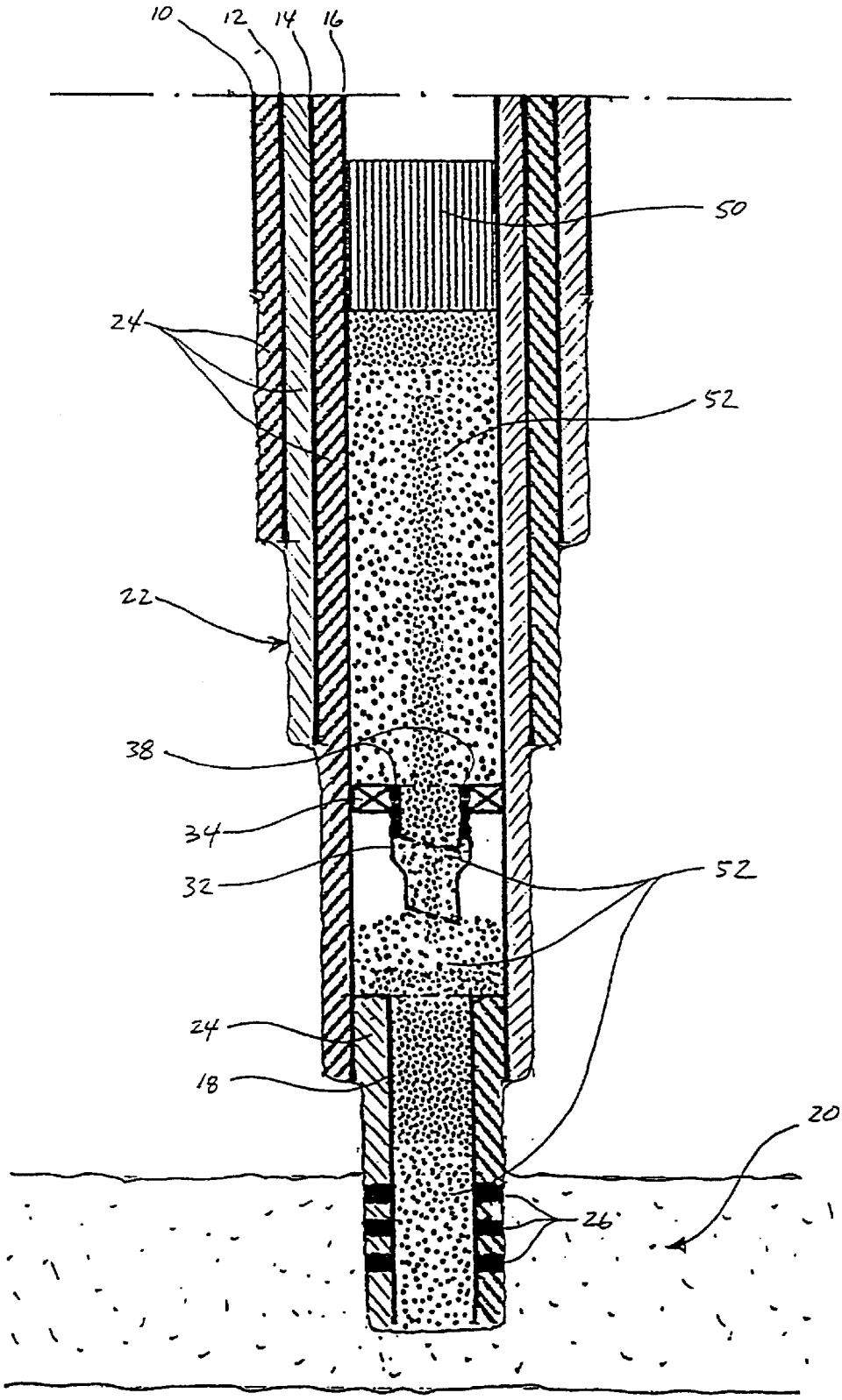
FIG. 3 shows a schematic cross section of production well where the production tubing has been removed, and where particulate material constitutes the majority of the well plugging.

FIG. 3 shows one example of application of the invention, where a production well is plugged by particulate matter through the majority of the length after the production tubing is removed. In this example a continuous plug of particulate matter 52 is placed in the liner 18 and further all the way in the casing 16. A cement plug 50 on the top can eventually be placed as a seal over the particulate matter plug 52, eventually to the land surface.

What is claimed is:

1. A particulate matter plug for plugging a well in connection with permanent or temporary abandonment of the well, the particulate matter plug comprising:

a mass of granular particulate matter, wherein the granular particulate matter having average particle diameters included in a statistical range of variation of said mass is comprised of particles with an average particle diameter >1/256 millimeters (Krumbein ø-value<8), the statistical distribution of particle sizes in said mass denoting the statistical range of variation (in Krumbein ø-values) comprising approximately 2/3 of all particles in said mass, and the range of variation statistically equaling two times the standard deviation of the particles in the mass of particulate matter.

2. The particulate matter plug of claim 1, wherein the mass of granular particulate matter comprises a mixture of gravel, sand, silt and clay.

3. The particulate matter plug of claim 1, wherein the mass of granular particulate matter comprises naturally occurring granular matter.

4. The particular matter plug of claim 1, wherein the mass of granular particulate matter comprises synthetically produced granular matter.

5. The particulate matter plug of claim 1, wherein the mass of granular particulate matter comprises naturally occurring granular matter and synthetically produced granular matter.

6. The particulate matter plug of claim 1, wherein the statistical range of variation of said mass is >1, as denoted in Krumbein ø-values, the smallest particle of said range of variation having an average particle diameter >1/256 millimeters (Krumbein ø-value<8).

7. The particulate matter plug of claim 1, wherein the statistical range of variation of said mass is <1, as denoted in Krumbein ø-values, the smallest particle of said range of variation having an average particle diameter >1/256 millimeters (Krumbein ø-value<8), and where said mass being chosen within this statistical range of variation consists of particles having an average particle diameter in the range of ≦1/8 millimeters and >1/256 millimeters (Krumbein ø-values≧3 and <8), corresponding to particles classified in the particle size range equal to or smaller than very fine sand (≦1/8 millimeters) but larger than clay particles (>1/256 millimeters).

8. The particulate matter plug of claim 1, wherein the particle sizes and their distribution in said mass vary along the length of the well.

9. The particulate matter plug of claim 1, wherein the particles of said mass are irregular in shape.

10. The particulate matter plug of claim 1, wherein said mass of granular particulate matter is mixed with a carrier fluid, and that the fluidized mass of particulate matter, when placed in the well, thus is pumpable or dumpable.

11. The particulate matter plug of claim 1, wherein the particulate matter plug is used in combination with at least one conventional plug.

12. The particulate matter plug of claim 1, wherein the particulate matter plug is used in combination with at least one cement plug.

13. The particulate matter plug of claim 1, wherein the particulate matter plug is used in combination with at least one plug containing resin additive.

14. A particulate matter plug for plugging a well in connection with permanent or temporary abandonment of the well, the particulate matter plug comprising:

a mass of granular particulate matter, wherein approximately 2/3 of all particles in, said mass of granular particulate matter have an average particle diameter >1/256 millimeters.

15. The particulate matter plug of claim 14 wherein the mass of granular particulate matter comprises a mixture of gravel, sand, silt and clay.

16. The particulate matter plug of claim 14, wherein the mass of granular particulate matter comprises naturally occurring granular matter.

17. The particulate matter plug of claim 14, wherein the mass of granular particulate matter comprises synthetically produced granular matter.

18. The particulate matter plug of claim 14, wherein the mass of granular particulate matter comprises naturally occurring granular matter and synthetically produced granular matter.

19. The particulate matter plug of claim 14, wherein the statistical range of variation of said mass is >1, as denoted in Krumbein ø-values, the smallest particle of said range of variation having an average particle diameter >1/256 millimeters (Krumbein ø-value <8).

20. The particulate matter plug of claim 14, wherein the statistical range of variation of said mass is <1, as denoted in Krumbein ø-values, the smallest particle of said range of variation having an average particle diameter >1/256 millimeters (Krumbein ø-values<8), and wherein said mass being chosen within this statistical range of variation consists of particles having an average particle diameter in the range of ≦1/8 millimeters and >1/256 millimeters (Krumbein ø-values≧3 and <8), corresponding to particles classified in the particle size range equal to or smaller than very fine sand (<1/8 millimeters) but larger than clay particles (>1/256 millimeters).

21. The particulate matter plug of claim 14, wherein the particle sizes and their distribution in said mass vary along the length of the well.

22. The particulate matter plug of claim 14, wherein the particles of said mass are irregular in shape.

23. The particulate matter plug of claim 14, wherein said mass of granular particulate matter is mixed with a carrier fluid, and that the fluidized mass of particulate matter, when placed in the well, thus is pumpable or dumpable.

24. The particulate matter plug of claim 14, wherein the particulate matter plug is used in combination with at least one conventional plug.

25. The particulate matter plug of claim 14, wherein the particulate matter is used in combination with at least one cement plug.

26. The particulate matter plug of claim 14, wherein the particulate matter plug is used in combination with at least one plug containing resin additive.

* * * * *